US005937954A

United States Patent [19]

Puttmann et al.

[11] Patent Number: 5,937,954

[45] Date of Patent: Aug. 17, 1999

[54] METHOD FOR DIRECTIONAL DRILLING

[75] Inventors: Franz-Josef Puttmann; Alfons Hesse, both of Lennestadt, Germany

[73] Assignee: Tracto-Technik Paul Schmidt Spezialmaschinen, Lennestadt, Germany

[21] Appl. No.: 08/823,847

[22] Filed: Mar. 25, 1997

[30] Foreign Application Priority Data

Mar. 30, 1996 [DE] Germany ..... 196 12 902

[51] Int. Cl.[6] ..... E21B 7/04

[52] U.S. Cl. ..... 175/61; 175/73; 175/91; 175/221

[58] Field of Search ..... 175/61, 73, 91, 175/106, 108, 231

[56] References Cited

U.S. PATENT DOCUMENTS

| | | | |
|---|---|---|---|
| Re. 33,793 | 1/1992 | Cherrington et al. | 175/61 |
| 2,324,102 | 7/1943 | Miller et al. | 175/61 X |
| 2,707,616 | 5/1955 | Schad et al. | 175/61 X |
| 3,878,903 | 4/1975 | Cherrington . | |
| 4,307,786 | 12/1981 | Evans | 175/61 X |
| 4,995,465 | 2/1991 | Beck et al. | 175/61 X |

FOREIGN PATENT DOCUMENTS

| | | |
|---|---|---|
| 0 195 559 | 9/1986 | European Pat. Off. . |
| 0 247 767 | 12/1987 | European Pat. Off. . |
| 35 03 893 | 10/1985 | Germany . |

*Primary Examiner*—Roger Schoeppel

[57] ABSTRACT

In a method for directional drilling with the aid of a drilling device having a drill pipe and a mining tool which moves on an orbit, the tool moves at an essentially constant angular velocity during straight drilling and the angular velocity is periodically changed during curved drilling, in order to thus create a smooth transition from straight drilling to curved drilling and to achieve more precise curve control.

18 Claims, 7 Drawing Sheets

METHOD FOR DIRECTIONAL DRILLING

Figure 1:
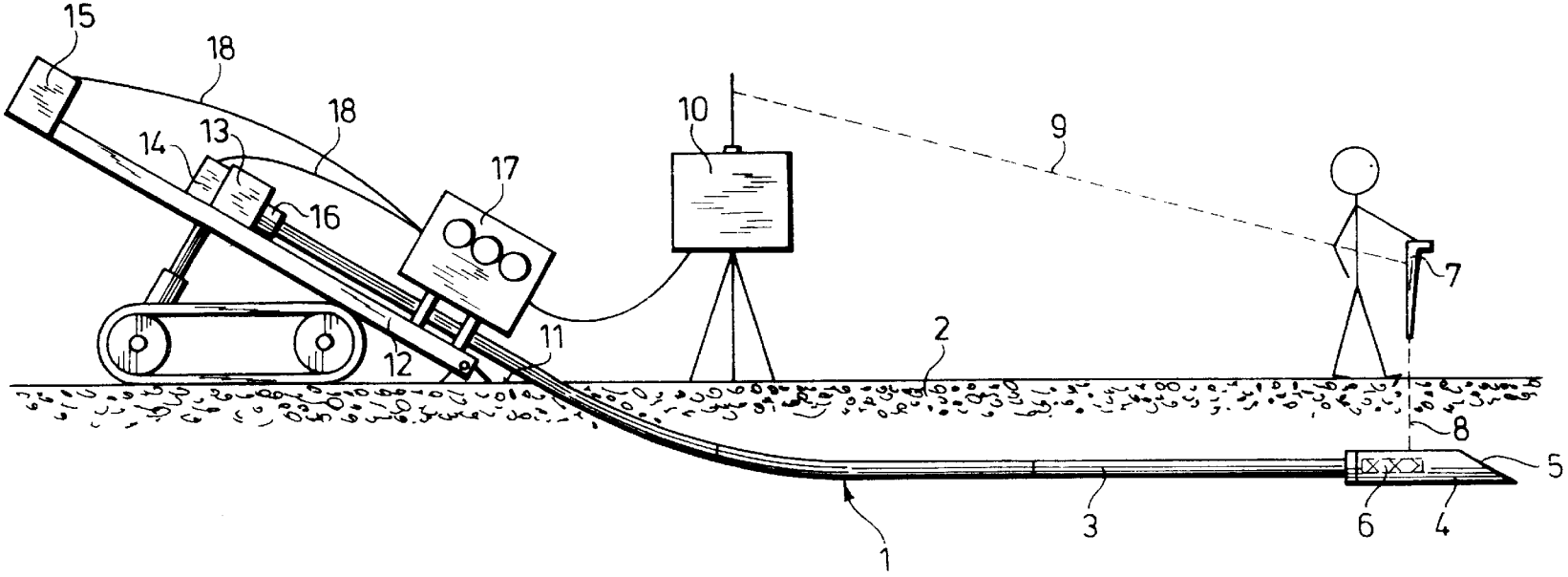

The invention relates to a method for directional drilling with the aid of a mechanic and/or hydraulic mining drilling device, which optionally permits straight operation or operation along a curved path.

Such drilling devices consist of a turning and/or percussive-driven pipe string having a drilling head, the configurations of which vary widely. The pipe string typically is supported on a rail-mounted cradle connected to a linear drive and possesses a rotary drive or rotary percussion drive with which it is possible to set the drill pipe into rotation and, if required, to drive the same into the ground.

In order to enable directional drilling, such devices possess an eccentricity which causes a curved course, but which may be overcome for straight drilling. This is carried out in such a way that the part which features eccentricity rotates at a uniform angular velocity during straight drilling, thereby losing the effect of the eccentricity. In the transition to curved drilling, the part which features eccentricity or the drilling head is stopped at a given angle for a certain amount of time and remains at said angle until the curved path is completed or for as long as the prescribed curved path is maintained. If the drilling head leaves the leg of trajectory provided, correction of the angle is required until the leg of trajectory has again been achieved and the drilling head must again be adjusted to the leg of trajectory. The drilling head generally must be positioned in this way with respect to its angle several times in the course of a (longer) curve. Consequently, several angular steps are always required of the drill pipe, which otherwise does not rotate during a curved course. This results in a zigzag-shaped or corkscrew-shaped ground drilling, but not in a precise curved path.

The respective angle of eccentricity is a function of the direction of curvature of the ground drilling to be prepared; however, the eccentricity is always located on the inside of the curved path, where it simultaneously develops the effect of a center of motion, whereas the side opposite it acts as a shoulder or sliding block sliding along in the ground as on a guide board, as the drill pipe or drilling head is mechanically driven forward, without rotation, by means of pushing and/or percussion. The ground located in front of the drilling head is laterally displaced by the drilling head during the rotation-free curved drilling and/or more or less mined with the aid of a sharply defined liquid jet. But this is possible only for ground which is not altogether too solid, which is free of obstacles and also which can be displaced.

The type of pipe string, eccentricity and drilling head varies widely in individual cases. Thus, U.S. Pat. No. 3,878,903 describes a device having a drill pipe consisting of a rotating outer pipe and a driven internal drill pipe which is connected to a mining tool. The pipe string is offset in the vicinity of the drilling head and, as a result, permits a curved drilling, in which both the radius of the curve as well as the direction of curvature may be changed by means of an angular adjustment of the pipe string. With a continuously rotating drill pipe, straight drilling is possible with a substantially enlarged diameter of the ground channel. Said diameter corresponds with the diameter of the envelope described by the point of the drilling head and is greater, the greater the offset of the front section of the drill pipe.

In addition, European Laid-open Patent No. 0,247,767 describes a drilling head with sloped surface, connected to a turning/push drill pipe, which permits straight drilling provided that the drilling head is rotating uniformly and, without rotation, permits a curved drilling by means of a lateral displacement of the soil located in front of the drilling head.

European Patent No. 0,195,559 describes a device with similar operation, the offset drilling head of which, however, is provided with a concentric nozzle, from which emerges a high-pressure jet in order to loosen and mine the soil located in front of the drilling head.

In order to be able to find the position of the drilling head in the ground, a transmitter, e.g., provided with power by means of batteries, may be arranged in the drilling head; the transmitter is provided with measuring devices which enable it to establish at what depth the drilling head is located where it is located in the ground, and the inclination and roll of the drilling head with respect to its axis, i.e. the angular position of the sloped surface with respect to the longitudinal axis. In addition, the temperature of the drilling head also may be established.

The measured data is transmitted by the transmitter arranged in the drilling head to a receiver at ground level and displayed there. From there, the data is transmitted in wireless fashion to the operator at a rotation and feed unit and displayed there as well. A steering maneuver may be triggered with the aid of this data.

The known methods and devices for directional drilling are all based on the principle that the pipe string rotates during straight drilling and, consequently, the drilling head describes an envelope having a diameter which is greater, generally, substantially greater than the diameter of the drill pipe or drilling head, while the drill pipe does not rotate during a curved course and drilling propulsion is carried out by means of pushing and/or percussion alone.

In the transition from straight drilling to curved drilling, an abrupt interruption is required of the rotational movement at a given angle of the drilling head specified by means of the direction of curvature. This is coupled with a likewise abrupt or marked change of the advance direction. This, in turn, is defined solely by means of the type and degree of eccentricity, e.g., the inclination of a sloped or steering surface at the drilling head with respect to the main axis of the drill pipe. Since the eccentricity or inclination is structurally prescribed, directional changes—e.g. correctional changes—are possible during a curved course, in each case, only in such a way that the angle of the drilling head; or the eccentricity is changed by means of rotating the drill pipe by a given angle. Since several correctional changes of direction typically are required during one curved course, the resultant ground channel follows a path more or less in the shape of a zigzag or—in accordance with the condition of the drilling head—in the shape of a corkscrew. This works to extreme disadvantage during subsequent expansion of the pilot hole with the aid of an expanding head and/or when inserting a pipeline into the pilot hole, since the ground drilling follows an irregular path precisely in the especially critical curved region and possesses an irregular wall, which opposes the expanding head and/or the insertion pipeline with a high level of slippage resistance. This necessitates an increased technical cost during expansion and insertion. Added to this is the instability of such a ground channel wall, which is coupled with the danger of downfalls, increases the difficulty during expansion and pipe insertion and, more specifically, brings with it the danger of damage to the pipe during insertion.

Therefore, the underlying purpose of the invention is to create a method that permits a smooth directional change and one which protects the drill pipe as well as the drilling head and, even in the curved region, results in a ground channel which is smooth-walled to the greatest extent and which has a uniform curvature.

The solution to this problem is based on the basic idea of resolving the one steering step per curved path or curved path section typical in the conventional method, without stopping the rotating pipe string, into a multitude of individual steering steps with a minimal steering action, in order to achieve a continuously steered advance in this way.

In detail, the invention consists of a method for directional drilling with the aid of a drilling device having a drill pipe and a tool supported to move on an orbit, which rotates at an essentially constant angular velocity during straight drilling while, during curved drilling, the angular velocity is periodically changed for short times with respect to a reference velocity, i.e., is increased or decreased. The method in accordance with the invention consequently operates with a pulsating angular velocity during the curved course.

In this connection, the reference velocity is to be understood as that angular velocity which would guarantee straight drilling when drilling with a nonpulsating or constant angular velocity and with respect to which the change of angular velocity is carried out in accordance with the invention. Here, the changed angular velocity represents the steering velocity which is effective only during a given angular range.

A curved course can be carried out in such a way that the angular velocity is changed once per each rotation. The change can be carried out abruptly or also continuously and/or, in each case, after several rotations. The more frequent the changes, the more uniform and smooth the directional change.

In the method in accordance with the invention, the radius of curvature of a curved course is a function of the relationship between the reference velocity and steering velocity. Said relationship determines the intensity of ground mining and displacement on the two sections of the envelope, corresponding, on one hand, to the reference velocity and, on the other hand, to the steering velocity, and said intensity results for one rotation of the tool.

If the change in angular velocity for the method in accordance with the invention is represented graphically, by means of a time axis, then, in accordance with the change in velocity, an abrupt change results in a meandering graph, and a continuous change results in a sinusoidal graph if the degree of change in velocity is the same in each case. But it does not have to be this way, since it is also entirely possible to operate in phases with varying changes in the angular velocity. However, it is preferable for the change in angular velocity to be carried out in temporarilly identical intervals for as long as the curved course is sustained.

In the method in accordance with the invention, the steering action can also be supported by means of exerting a temporally-offset accelerating percussion or pushing on the pipe string and/or drilling head, preferably during rotation at the reference speed.

The nature of the pipe string, drilling head and mining tool plays no role in the method in accordance with the invention; it is decisive only that the drilling head or the mining tool located at the drilling head describe an envelope during rotation of the drill pipe, within which envelope an eccentricity or asymmetry is present.

Several tools also come into question under this precondition for the method in accordance with the invention, which accordingly are grouped eccentrically. In accordance with the composition of the ground, a nozzle arranged on the axis of rotation that supplies a mining cutting jet also may serve as the mining tool.

However, a device having a driven pipe string consisting of a curved guide pipe or outer pipe and a driven tool supported in the guide pipe is particularly suitable for the method in accordance with the invention. The guide pipe can be offset in a part adjacent to the drilling head and/or can be provided with a steering surface. A conventional drive as described, e.g., in German Patent No. 3,503,893, is suitable for the drill pipe and drilling tool, or drilling head, and is to be a component of this description. However, as an alternative, it is suggested to drive the drilling head or mining tool hydraulically with the aid of a so-called mud motor, to which a liquid medium, e.g., a bentonite/water suspension, is supplied as a driving medium, which simultaneously finds use as a cooling liquid and/or transport medium for the mined ground.

However, mud motors can be used only to a limited degree, since their capacity is a function of the pressure or the quantity of driving liquid with which they are supplied. Large levels of torque and mining capacity consequently require correspondingly large quantities of liquid, which is coupled with considerable problems. If it is a question of a bentonite/water suspension, frequently thixotropic, then the bentonite consumption results in a high cost. In addition, transporting the suspension through the pipe string leads to severe wear. Also, if the large quantities of suspension or water remain in the ground, they may lead to an undesirable rinsing, or, with high hydrostatic pressure, to damage at the ground surface, e.g., on pavement, or they must be led back, which requires a corresponding section of pipe in the pipe string or a corresponding annular space between the pipe string and the surrounding ground as well as a preparation for the reuse of the bentonite. Finally, large quantities of water require a correspondingly large pumping capacity, which is coupled to high cost.

Therefore, an external drive of the drilling tool or drilling tools by means of a pipe string, by means of which a large torque may be transferred, is more advantageous. In the simplest case, the pipe string consists of one string, preferably hollow, having an eccentrically arranged mining tool, which moves on an envelope as the pipe string rotates. This can be brought about with the aid of a gently curving string or by arranging the drilling tool outside the axis of the pipe string or axis of rotation.

But the pipe string may also consist of two concentric pipes, each of which possess a separate rotary drive. Here, the internal pipe is connected to the drilling head or to a mining tool, while the outer pipe is fitted with tools or may be provided with a bore-crown.

In order to improve ground mining and the transporting away of loosened soil, the mining tool, the drilling head and/or the guide pipe may be provided with nozzles for a liquid supplied, preferably, through the internal pipe. The liquid may serve for cooling, for transporting away loosened soil or, in the form of a sharply defined jet, for ground removal.

The axis of rotation of the drilling head or of the mining tool can be arranged eccentrically with respect to the axis of the drill pipe, in order to produce a tool movement on the aforementioned envelope during rotation of the drill pipe.

The loosened soil can be transported away by means of an annular gap between the guide pipe and the ground, if the diameter of the mining tool is greater than the diameter of the guide pipe. However, it is more favorable to transport away through the guide pipe, for which openings for excavated material must be located in the drilling head and/or in the guide pipe. One may improve the transporting away through the interior of the guide pipe with the aid of a conveyor worm arranged there and/or by means of nozzles for a liquid.

On the other hand, the possibility also exists of developing the front part of the pipe string to be pivoting, in order to thus be able to work with varying angles of inclination.

The invention is explained in greater detail in the following with the aid of the embodiments represented in the figure. In the figures are shown:

FIG. 1: A drilling device suitable to execute the method in accordance with the invention, in action, FIG. 2: A pipe string with offset front part and a mud motor, FIG. 3: A single-pipe drill pipe with eccentrically arranged mud motor, FIG. 4: A double-pipe drill pipe with an eccentrically arranged tool powered from an internal pipe, FIG. 5: A similar pipe string, which is suitable for internally transporting away loosened soil, FIG. 6: A double-pipe drill pipe with offset front section, and FIG. 7: A similarly composed pipe string, the front part of which, however, is of a pivoted design.

In the method in accordance with the invention, a ground drilling (1) is produced in the ground (2) by means of an elastic pipe string (3) consisting of individual pipes. Located at the end of the pipe string (3) is a drilling head (4) having a steering surface or bevel (5) which is connected to the pipe string (3) in a nonrotating fashion. The front edge of the bevel acts as a mining tool and when the drill pipe is rotating describes an envelope about the axis of the drill pipe. A transmitter (6) is arranged in the drilling head (4), which transmits wireless data to a receiver (7). Said data refers to the depth of the drilling head (4) under the earth's surface, the location of the drilling head (4) in the ground, its inclination, the angular position of the steering surface (5) with respect to the longitudinal axis of the drilling head (4) and, if required, the temperature at the drilling head (4). The dashed line (8) indicates a radio connection between the transmitter (6) and a receiver (7).

An additional radio connection (9) transmits the aforementioned data from the receiver (7) to a display device (10) in the vicinity of a percussive rotation and feed unit (12) arranged at the start (11). This rotation and feed unit (12) features a rotary drive (13) for the pipe string (3), a percussion mechanism (14) which impinges on the pipe string (3), and an advance drive (15). The pipe string (3) is coupled to the rotation and feed unit by means of a pipe string connection (16).

From the display device (10) a cable connection leads to a switch box (17) with a control console, by means of which it is possible to control, by means of one cable connection (18) in each case, the rotary drive (13), the percussion mechanism (14) and the feed drive (15).

The device represented in FIG. 1 may be operated in two different ways. When the pipe string (3) is driven through the ground (2) in a rotating and pushed fashion, a straight drilled hole results. The uniform rotation of the pipe strand (3) neutralizes the deflection of the drilling head (4) operating off-center. Said deflection is made possible due to the steering surface (5) on the drilling head.

A curved course is introduced for the device represented in FIG. 1, by means of the fact that the motion of revolution (angular velocity) of the drilling head (4) is slowed during each rotation to a given steering velocity, for a short time, e.g., in the region of the represented control setting or angular position of the sloped surface (5) with reference to the pipe string (3), or accelerated for a short time in the angular position offset by 180° in comparison to this position. This results in a curved path which curves downward, for as long as said periodic change in velocity is carried out.

The same effect may be achieved if the pipe string consists of two concentric strings and if at least one tool is located at one of the strings, where the steering surface (5) terminates in a point or cutting edge. Said tool may be driven and moves on an envelope about the axis of the drill pipe if the string to which the tool is connected is rotating. This is possible, for example, with a drill pipe consisting of two concentric pipes, where the internal pipe is provided with an eccentrically arranged tool or a limited section of the end of the outer pipe is in the form of a bore-crown.

Figure 2:
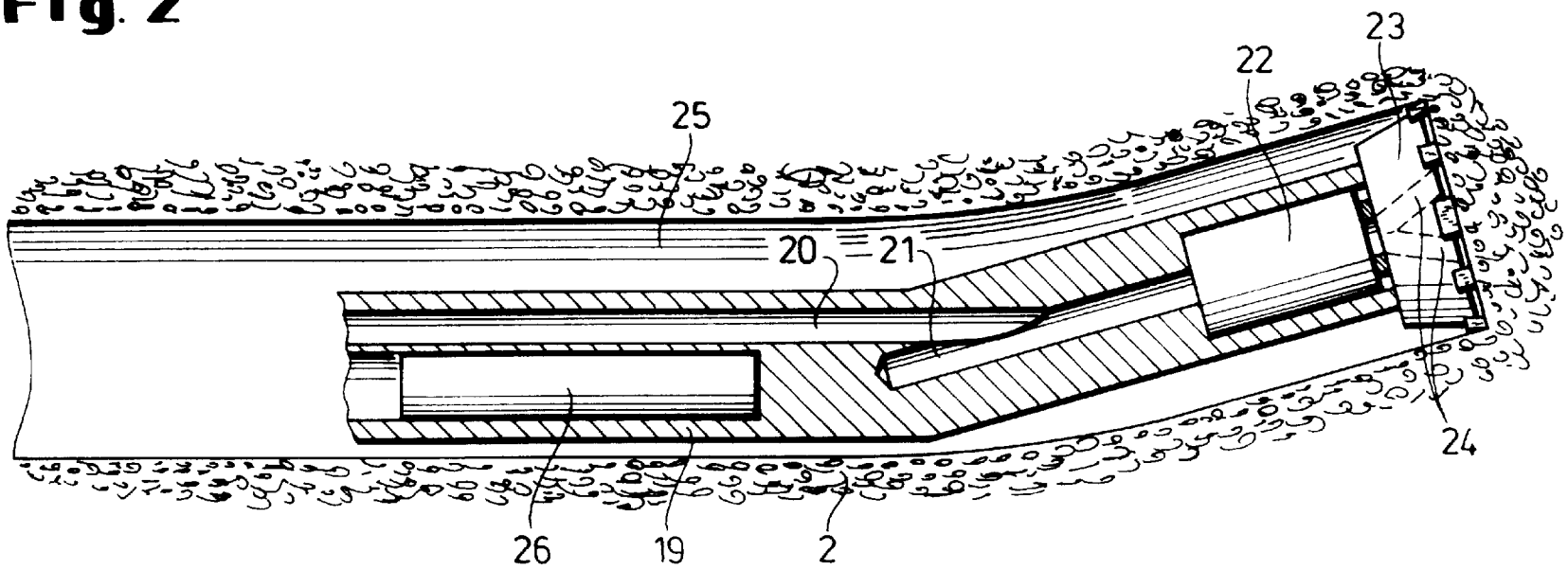

In the embodiment represented in FIG. 2, the pipe string consists of a drilling lance (19) which bends off, having a drilled hole (20,21) which leads to a mud motor (22) which is supplied with driving fluid by means of a drilled hole (20,21). The mud motor drives a centrally arranged mining tool (23) with nozzle (24), by means of which the driving fluid emerges, in order to support the ground mining and/or to improve the transporting away of the loosened soil by means of the annular space (25) between the drilling lance (19) and the ground (2).

The drilling lance (19) includes a measuring and transmitting unit (26) to record and relay the measuring data required for steering.

Figure 3:
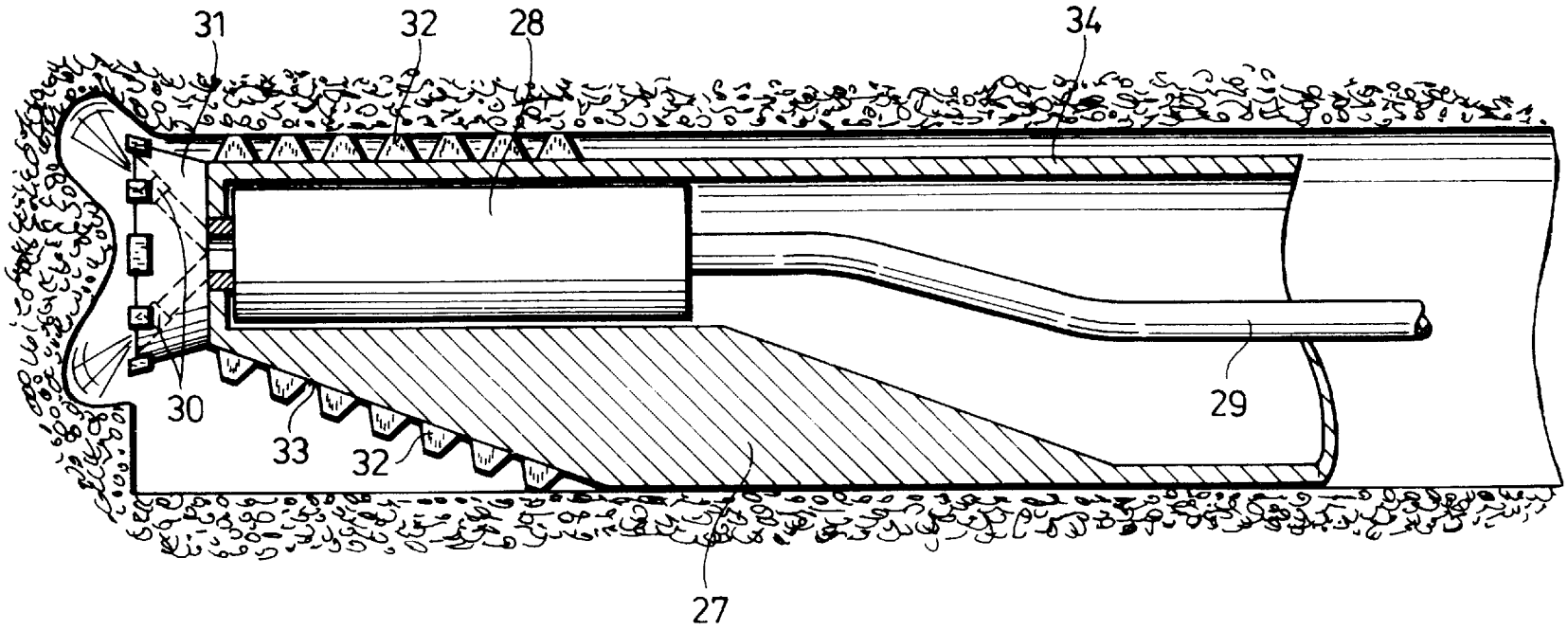

An additional one-pipe drill pipe (27) is represented in FIG. 3 and includes a mud motor (28) which is supplied with driving liquid by means of a hose pipe (29). Said driving liquid leaves the mud motor by means of nozzles (30) of an eccentrically arranged mining tool (31). The front end of the pipe string (27) is fitted with tools (32) and possesses a steering bevel (33), which, during a curved course is supported by the wall, created by the tool (31), of the ground adjacent to the steering bevel. The curved course is carried out when the pipe (27) of the drill pipe, in the region of the angle represented in FIG. 5, is rotated for a short time at a velocity which differs positively or negatively from the reference velocity.

Figure 4:
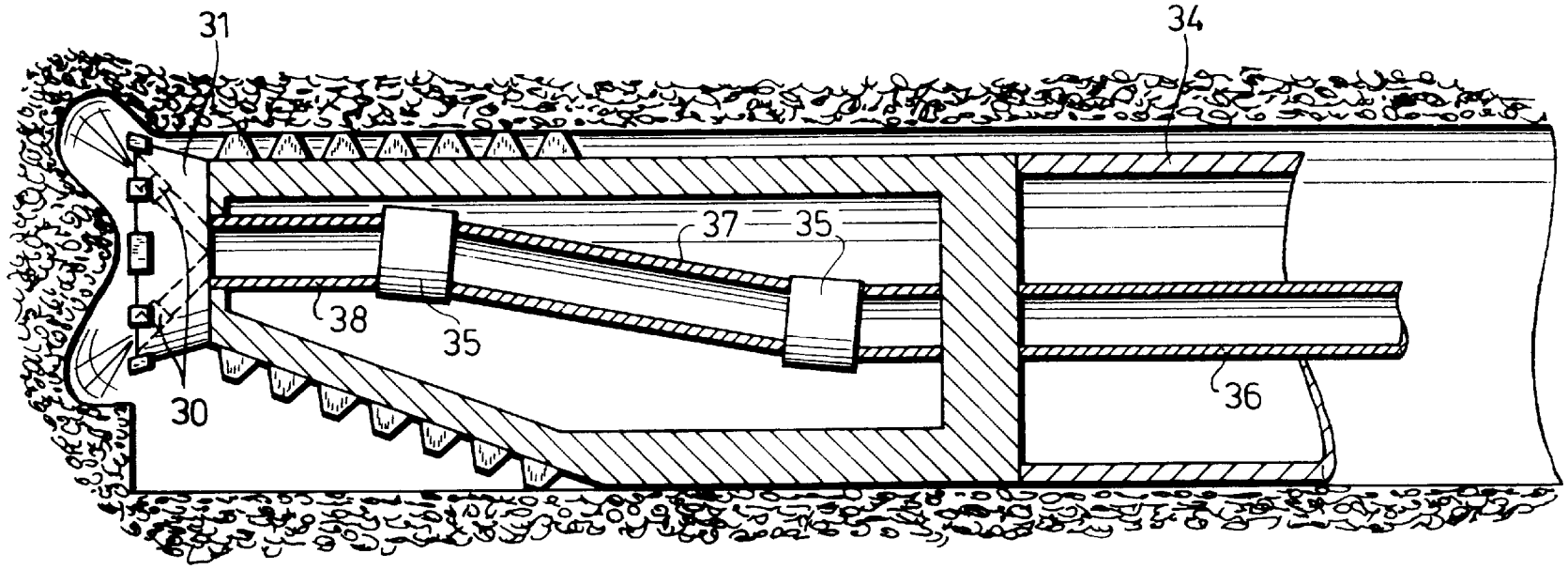

The mining tool (31) may be driven, in accordance with the representation in FIG. 4, for a double-pipe drill pipe, with an outer pipe (34) and also by means of a tubular internal drill pipe consisting of several partial pieces (36, 37,38) connected to each other by a universal joint (35) respectively. The universal joints may be omitted if the internal drill pipe is sufficiently flexible.

Figure 5:
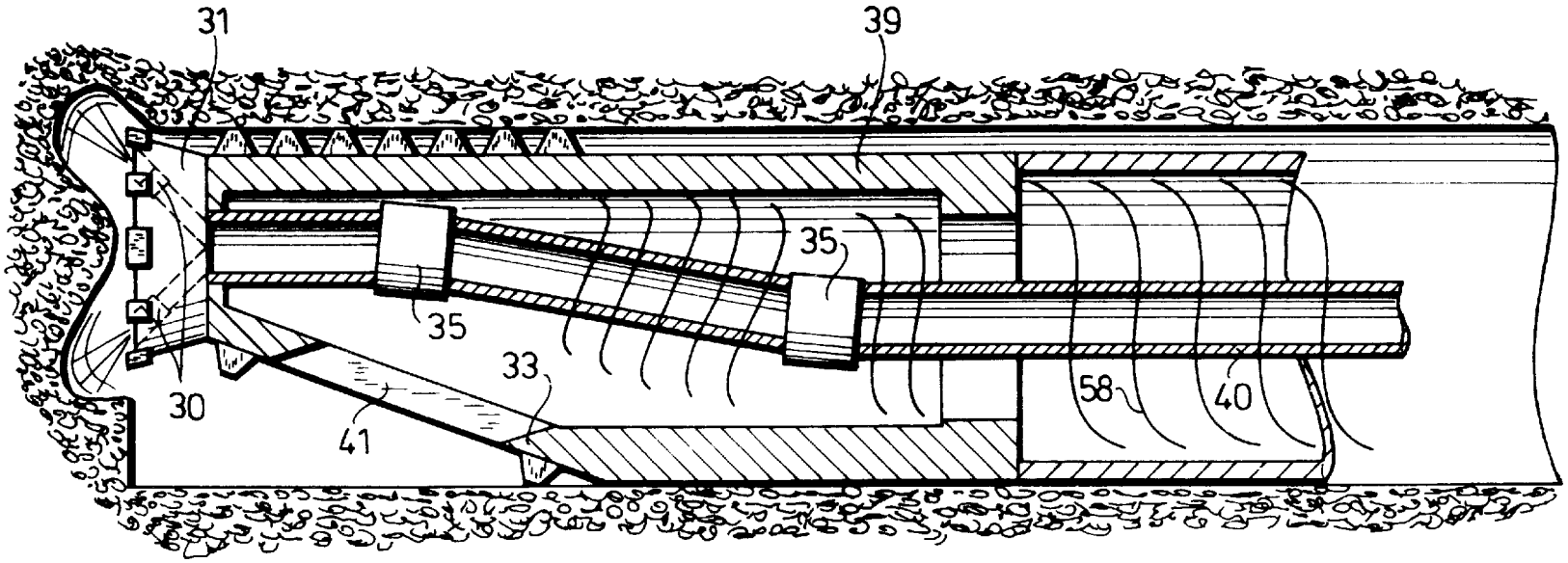

In order to improve the transporting away of the soil loosened by the mining tool (31) in cooperation with the liquid jets emerging from the nozzles (30), the outer pipe (39) of the double-pipe drill pipe (39,40) features, for the embodiment of FIG. 5, an opening (41) for excavated material, and the internal pipe (40) is fitted with shovels (58) which transport soil, entering the outer pipe (39) by means of the opening (41) for excavated material, away in the direction of the drive for the pipe string.

Figure 6:
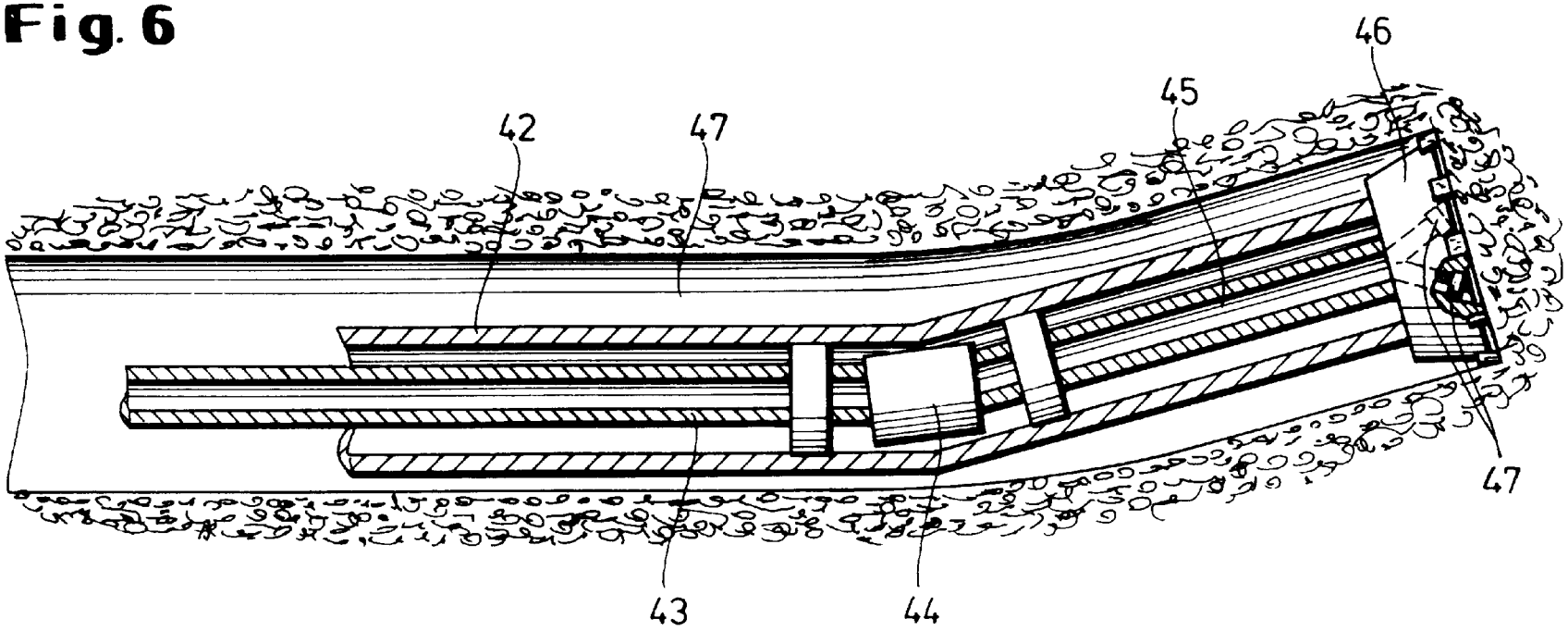

In the embodiment in FIG. 6, the guide pipe or outer pipe (42) of the pipe string is offset, while the internal pipe consists of a pipeline conduit (43) which is connected, by means of a universal joint (44), to an inner section of pipe (45), which is connected in a nonrotating fashion to a mining tool (46). The diameter of the mining tool (46) is greater than the diameter of the guide pipe (42) and therefore creates an annular space (47) by means of which, loosened soil which is mixed with liquid emerging by means of nozzles (47) of the mining tool (46) is transported away peripherally.

Figure 7:
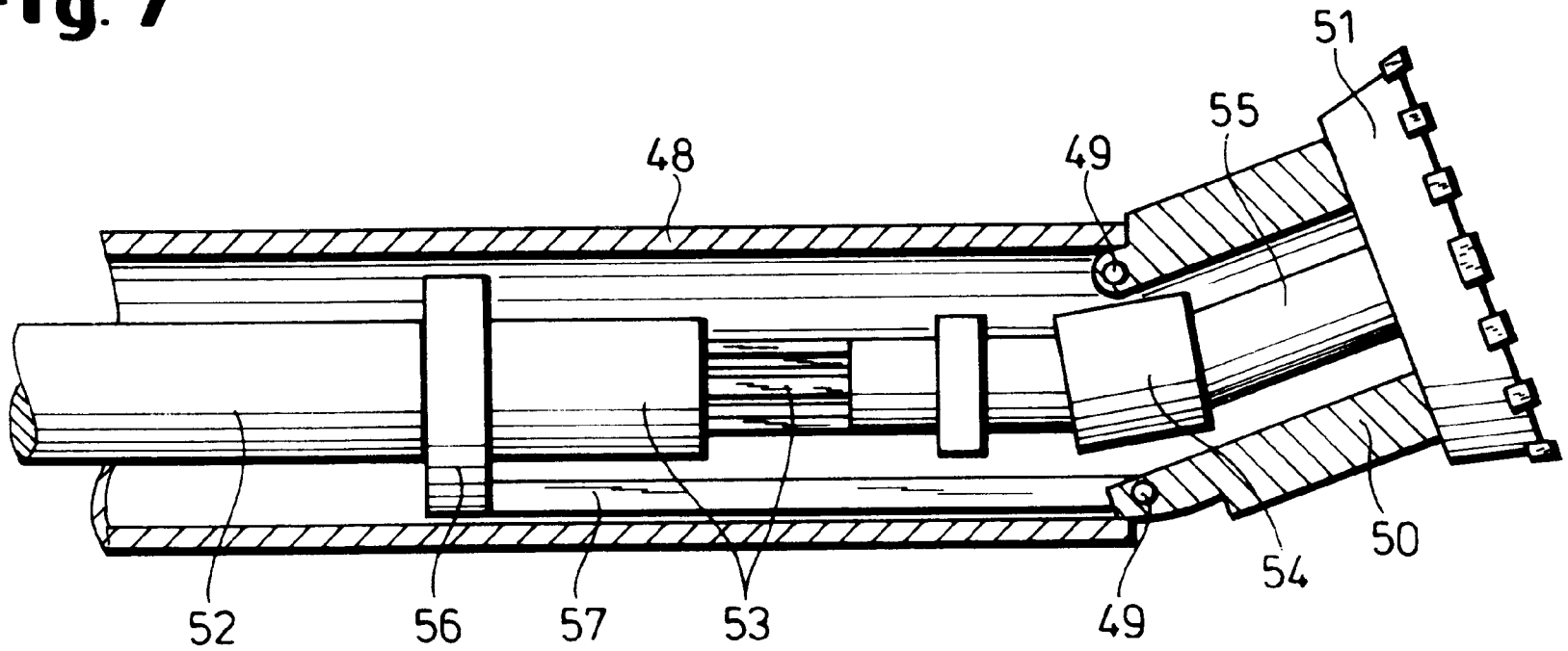

For the pipe string of FIG. 7, consisting of a guide pipe (48) and a pipe section (50) connected to the former by means of a joint (49), the mining tool (51) is driven by means of an internal drill pipe (52) which is connected by means of a coupling (53), e.g., in the form of a spline shaft, and a universal joint (54) to the driving shaft (55) of the mining tool (51). A collar (56) of the internal drill pipe (52)

is connected to the pipe section (50) by means of a connecting rod (57) and with longitudinal shifting of the internal drill pipe (52) allows the pipe section (50) to pivot. In this way, the angle by which the pipe section (50) bends off and consequently the diameter of the straight section of a ground drilling may be adjusted infinitely as may the radius of curvature for a curved course.

One thing common to each embodiment is that a substantially uniform movement of the mining tool, arranged eccentrically with respect to the rotation axis of the drill pipe, on an envelope about the rotation axis results in a straight bore section and a rotation with a preferably uniform pulsating angular speed results in a curved course, the radius of curvature of which is a function of the geometry of the pipe string and/or of the drilling tool as well as of the deviation of velocity in relationship to the reference velocity.

We claim:

1. A method for directional drilling, comprising:

rotating a drilling device comprising a drill pipe and a mining tool mounted on the drill pipe, whereby the mining tool is rotated at an essentially constant angular velocity for drilling in a straight line and the angular velocity of the rotation of the mining tool is periodically changed for drilling in a curved path.

2. The method of claim 1, wherein the angular velocity is changed once per rotation of the mining tool in a given angular range.

3. The method of claim 1, wherein during drilling in a curved path, the angular velocity of the rotation of the mining tool is changed at temporally identical intervals.

4. The method of claim 1, wherein an accelerating percussion or pushing force is exerted on the drill pipe at a time offset from a time where the angular velocity is changed.

5. The method of claim 4, wherein the accelerating percussion or pushing force is exerted on the drill pipe during a phase of higher angular velocity.

6. A device for directional drilling, comprising:

a rotationally driven pipe string;

a mining tool carried by the driven pipe string and arranged eccentrically with respect to an axis of a bore hole;

a controller for rotation of the pipe string and mining tool, whereby the controller rotates the mining tool at an essentially constant angular velocity for a drilling in a straight line and the angular velocity of the mining tool is periodically changed for drilling in a curved path.

7. The device of claim 6, wherein the driven pipe string comprises an angled or curved guide pipe and a driven tool carried by the guide pipe.

8. The device of claim 6, wherein the driven pipe string includes two concentric pipes.

9. The device of claim 8, wherein the internal pipe is driven and the mining tool is carried by the internal pipe.

10. The device of claim 9, wherein the mining tool is provided with nozzles, the nozzles being supplied with a liquid carried by the internal pipe.

11. The device of claim 8, wherein a forward end of the outer pipe is fitted with tools.

12. The device of claim 8, wherein the mining tool is mounted to the outer pipe in an articulated manner.

13. The device of claim 6, wherein the mining tool is driven by a mud motor and the pipe string supplies driving liquid to the mud motor.

14. The device of claim 6, wherein a front part of the driven pipe string is angled.

15. The device of claim 6, wherein the rotation axis of the mining tool is arranged eccentrically.

16. The device of claim 6, wherein the mining tool or a forward end of the driven pipe string is provided with a steering surface.

17. The device of claim 6, wherein the driven pipe string is provided with an opening for removal of excavated material.

18. The device of claim 17, further comprising at least one of a conveyer worm and nozzles for a liquid to transport excavated material away in the driven pipe string.

* * * * *